United States Patent [19]

Mörz

[11] 4,344,048

[45] Aug. 10, 1982

[54] FOUR-PORT NETWORK FOR SEPARATING TWO SIGNALS COMPRISED OF DOUBLY POLARIZED FREQUENCY BANDS

[75] Inventor: Günter Mörz, Ludwigsburg, Fed. Rep. of Germany

[73] Assignee: Licentia Patent-Verwaltungs-G.m.b.H, Frankfurt am Main, Fed. Rep. of Germany

[21] Appl. No.: 177,449

[22] Filed: Aug. 11, 1980

[30] Foreign Application Priority Data

Aug. 11, 1979 [DE] Fed. Rep. of Germany ..... 2932626
Aug. 11, 1979 [DE] Fed. Rep. of Germany ... 7923001[U]

[51] Int. Cl.³ ..... H01P 1/161; H01P 1/213
[52] U.S. Cl. ..... 333/135; 333/21 A
[58] Field of Search ..... 333/21 A, 117, 125, 333/126, 135, 137

[56] References Cited

U.S. PATENT DOCUMENTS 3,758,882 9/1973 Morz ..... 333/21 A
3,978,434 8/1976 Morz et al. .
4,047,128 9/1977 Morz ..... 333/21 A X

FOREIGN PATENT DOCUMENTS 2703878 8/1978 Fed. Rep. of Germany .

OTHER PUBLICATIONS

Morz, *Analysis and Synthesis of Electromagnetic Wave-fields in Reflector Antennas, etc.*, Dissertation, 1978, pp. 75–81.

*Primary Examiner*—Paul L. Gensler
*Attorney, Agent, or Firm*—Spencer & Kaye

[57] ABSTRACT

A four-port network for separating signals comprised of two doubly polarized frequency bands for an antenna feeder system in directional or satellite radio operation, wherein a first polarization converter for converting linear polarization to circular polarization, and vice versa, is designed for the lowest inherent ellipticity in the lower frequency band and is connected ahead of a symmetric polarization filter for the lower frequency band, and a second polarization converter which compensates the remaining ellipticity in the upper frequency band is connected between the symmetrical polarization filter and a further polarization filter for the upper frequency band. The second polarization converter for compensating the remaining ellipticity in the upper frequency band includes two different types of wavecoupling means with the first wavecoupling means reducing the frequency dependence of the remaining ellipticity but simultaneously increasing the amount of the remaining ellipticity and the other wavecoupling means having the resulting effect that the amount of the remaining ellipticity and additionally its frequency dependence are reduced to a minimum.

5 Claims, 8 Drawing Figures

FOUR-PORT NETWORK FOR SEPARATING TWO SIGNALS COMPRISED OF DOUBLY POLARIZED FREQUENCY BANDS

BACKGROUND OF THE INVENTION

The present invention relates to a four-port network for separating signals comprised of two doubly polarized frequency bands for an antenna feeder system in directional or satellite radio operation. More particularly, the present invention relates to such a network which includes a polarization converter for converting a linear polarization to a circular polarization and vice versa and designed for the lowest possible inherent ellipticity in the lower of the two frequency bands is connected ahead of a symmetrical polarization filter for the lower frequency band, and a second polarization converter is connected between this polarization filter and a futher polarization filter for the upper frequency band, and wherein the second polarization converter provides compensation for the remaining ellipticity in the upper frequency band.

Four-port networks are used in antenna systems, for example in satellite radio, for the separation of signals when the system is operated with double frequency utilization, where the one frequency band is provided for an up-link or transmission connection and the other frequency band is provided for a down-link or receive connection. Each frequency band has two associated linearly or circularly polarized (rotating clockwise, counterclockwise) signals. Circular polarization is used in the radio art for data transmission whenever parallel alignment of the polarization of the receiving antenna with the polarization of the receiving field intensity is not assured. In this connection, the time variable, nonreciprocal rotation of the polarization plane in satellite transmissions is a rotation which is effected due to the coaction of free electrons with the earth's magnetic field in the ionosphere, particularly at frequencies below 10 GHz.

If unequal transmission properties of the field components occur in the four-port network, the circular polarization changes to an elliptical polarization. The lower the ellipticity, i.e. the ratio of major to minor ellipse axis, the better is the polarization decoupling.

German Offenlegungsschrift No. DE-OS 27 03 878, laid open Aug. 8th, 1978, discloses a four-port network, in which, as shown in FIG. 1, the respective polarizations of two linearly polarized signals are initially separated by means of a polarization filter 1 and thereafter a pair of filters 2 and 3, are provided which filter the polarization components of lower frequency band (4 GHz) out of each polarization signal and transmit polarization components of the upper frequency band (6 GHz). In order to produce right or clockwise and left or counterclockwise circular signals in the respective lower and upper frequency bands, the signals in the lower and upper frequency bands, which have been separated into their respective linear polarization directions, are fed to respective 3 dB couplers 4 and 5 which effect a conversion into right or clockwise (rz) and left or counterclockwise (1z) circular polarization components. To achieve an ideal circular polarization, the signal paths associated with each 3 dB coupler 4 and 5 must have precisely the same propagation conditions. However, in reality this cannot be accomplished so that the circular polarization always exhibits some ellipticity.

The publication by the applicant G/UMl/u/ nther Mörz, "Analyse und Synthese von elektromagnetischen Wellenfeldern in Reflektorantennen mit Hlife von Mehrtyp-Wellenleitern" [Analysis and Synthesis of Electromagnetic Wavefields in Reflector Antennas with the Aid of Multiple-Type Waveguides], Dissertation, D82, RWTH-Aachen, Germany (1978), pages 75–81 and particularly pages 80 and 81, discloses a four-port network which provides measures for minimizing the ellipticity of the polarization. This four-port network as shown in FIG. 2, includes a first polarization converter 6 which receives linearly polarized signals from the antenna feedhorn (not shown) and converts them to circularly polarized signals or converts circularly polarized signals to linearly polarized signals and transmits them to the antenna feedhorn. This polarization converter 6, in the receiving direction, is followed by a polarization filter 7 which filters out or separates the circularly polarized clockwise (rz) and counterclockwise (1z) signals in the lower frequency band (e.g. 4 GHz) from the output of converter 6 and permits the signals in the upper frequency band (e.g. 6 GHz) to pass. The polarization filter 7 is followed in turn, by a second polarization converter 8 for the upper frequency band and a further polarization filter 9 for separating the clockwise and counterclockwise circular signals rz and 1z respectively in the upper frequency band. A polarization converter which is capable of converting a linearly polarized wave into a circularly polarized wave is disclosed, for example, in applicant's U.S. Pat. No. 3,758,882, issued Sept. 11th, 1973. According to the above-identified publication the first polarization converter 6 is to be designed to have the lowest possible inherent ellipticity (which is dependent upon the frequency) in the lower frequency band, whereas compensation for the remaining ellipticity in the upper frequency band is to be provided by the second polarization converter 8. With this arrangement, it is possible to provide separate minimization of the inherent ellipticity for each frequency band. If only one polarization converter were used, it would simultaneously have to be optimized for both frequency bands and consequently the ellipticity could not be reduced as far in either frequency band.

SUMMARY OF THE INVENTION

It is now the object of the present invention to provide a four-port network of the type discussed above which includes a polarization converter for the lower frequency band and a polarization converter for the upper frequency band wherein optimum compensation of the remaining ellipticity is effected for the upper frequency band with the lowest possible inherent ellipticity being set in the lower frequency band.

This is accomplished according to the present invention in that the second polarization converter includes two different types of wavecoupling means in order to compensate the remaining ellipticity in the upper frequency band, with one of the wavecoupling means being provided for reducing the frequency dependence of the remaining ellipticity but simultaneously increasing the amount of the remaining ellipticity and with the other wavecoupling means being provided to reduce to a minimum the amount of the remaining ellipticity and, in addition, its frequency dependence.

According to the preferred embodiment of the invention the second polarization converter comprises means for reducing the frequency dependence of the remaining ellipticity in the form of bevels disposed in two diagonally opposite corners of a square waveguide and, means for reducing the amount and additionally the frequency dependence of the remaining ellipticity in the form of a dielectric plate disposed between the other two diagonal corners of the waveguide. Preferably the bevels and the dielectric plate are provided with gradations to prevent reflections.

DETAILED DESCRIPTION OF THE PREFERRED EMBODIMENTS

Figure 1:
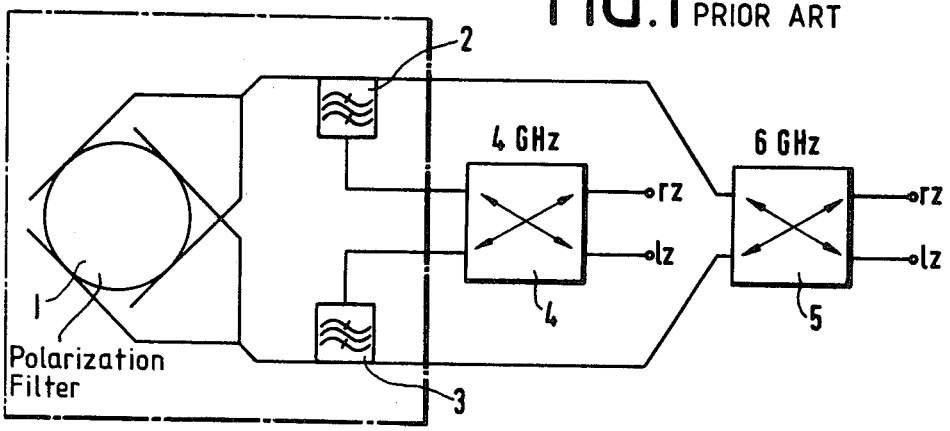
FIG. 1 PRIOR ART
FIG. 1 is a block circuit diagram of a four-port network for circularly polarized signals as disclosed in German Offenlegungschrift DE-OS No. 27 03 878.
Figure 2:
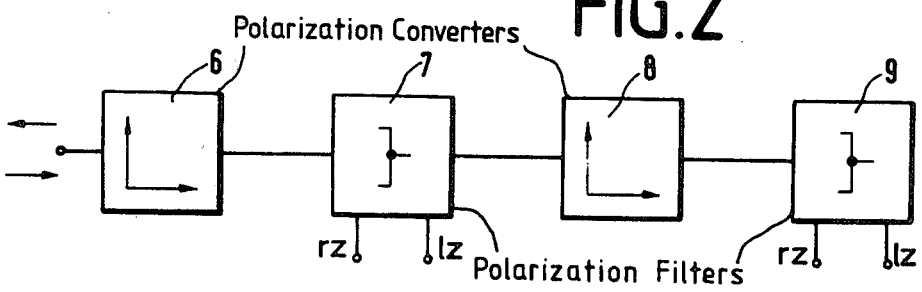
FIG. 2 shows the basic block circuit diagram for a four-port network for circularly polarized signals on which the present invention is based.

The present invention is based on a four-port network as it is basically shown in the block circuit diagram of FIG. 2 described in detail above. Such a four-port network for circular polarization can be realized by simply expanding and modifying the four-port network disclosed in applicant's U.S. Pat. No. 3,978,434 issued Aug. 31st, 1976, the subject matter of which is incorporated herein by reference. The four-port network or system separating filter described in this patent is capable of separating two signals each comprised of two doubly linearly polarized frequency bands, with the separation being effected with respect to their frequency bands and their directions of polarization. In general the four-port network includes a central waveguide body composed of a plurality of series connected waveguide sections one of which, 10 as in the above mentioned patent, is provided with a plurality of symmetrically arranged coupling elements (not shown in FIG. 4 and 5), frequency filter sections F1–F4, and pairs of waveguide arms 14 and 15, so that the waveguide section 10 and its associated components function as a symmetrical polarization filter by means of which the lower frequency band is coupled out and divided into its two polarization directions. Connected in front of the above-mentioned waveguide section 10, in the propagation direction from the antenna feedhorn (not shown), is a waveguide section constituting a first polarization converter 11 which is designed for lowest inherent ellipticity in the lower frequency band (3.7–4.2 GHz). Connected behind the central waveguide section 10 is a waveguide section constituting the polarization filter 12 for the upper frequency band (5.925–6.425 GHz). The second polarization converter 13 for compensating the remaining ellipticity in the upper frequency band is connected between waveguide section 10 from which the lower frequency band is coupled out and the polarization filter 12. In order to provide room in the central waveguide body for the second polarization converter 13, the pairs of waveguide arms 14 and 15 associated with the coupling means for coupling out the polarizations of the lower frequency band, are bent out of the plane of symmetry of the central waveguide body so as to bring together the coupled-out signals of each polarization direction. This is shown in FIG. 5 which is a top view in direction x of the four-port network shown in FIG. 4. Separated according to polarization directions, the signals of the lower frequency band are present at ports 16 and 16' and correspondingly the signals of the upper frequency band appear at ports 17 and 17'.

This arrangement has the advantage that it is built in a very space-saving manner and can thus also be used in small ground station antennas.

Figure 3:
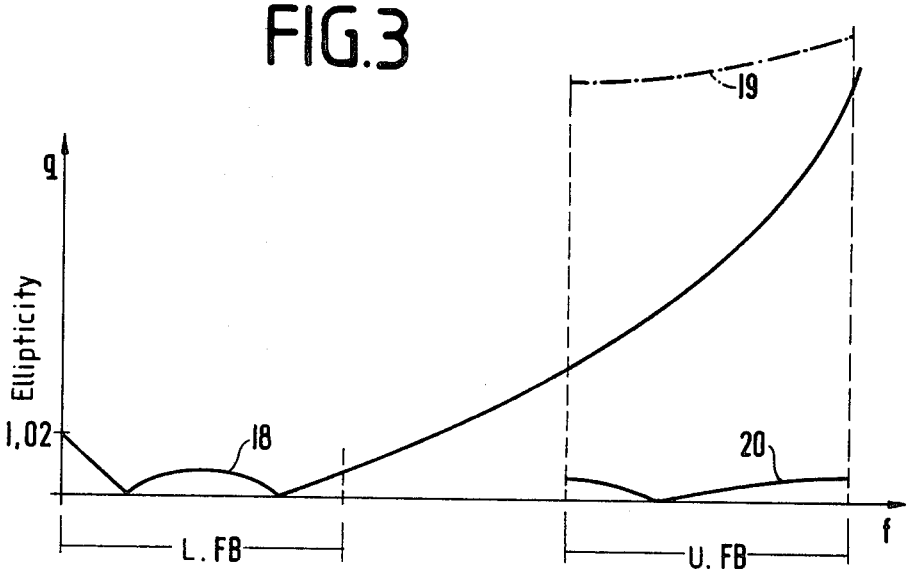
FIG. 3 shows curves of the ellipticity in dependence on frequency used in explaining the present invention.
Figure 4:
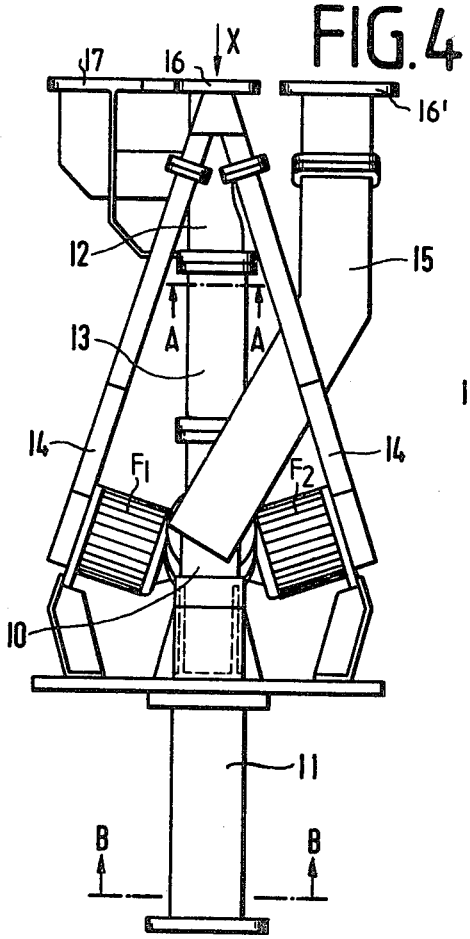
FIG. 4 shows the four-port network known from applicant's U.S. Pat. No. 3,978,434 which has expanded so as to realize a preferred embodiment of an apparatus according to the present invention.
Figure 5:
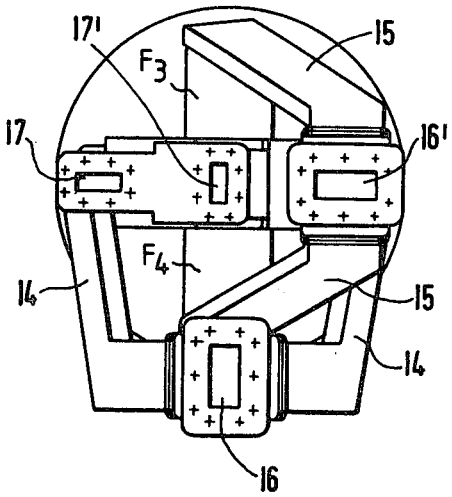
FIG. 5 is a top view in the direction x of the four-port network of FIG. 4.

Due to the fact that the first polarization converter 6 of FIG. 2 or 11 of FIG. 4 is designed for minimum inherent ellipticity in the lower frequency band, a curve 18 for the ellipticity in dependence on frequency, as shown in FIG. 3, would result if no compensation for the remaining ellipticity in the upper frequency band were provided. As can easily be seen from the curve 18, the ellipticity, although very favorable for the lower frequency band L.FB, is not good at all for the upper frequency band U.FB. There thus exists the need to reduce the amount and frequency dependence of the ellipticity (remaining ellipticity) of the upper frequency band U.FB. The present invention therefore provides a second polarization converter 8 in FIG. 2, and 13 in FIG. 4 for compensating the remaining ellipticity which polarization converter includes two different types of wavecoupling means. One of the wavecoupling means is intended to substantially reduce the frequency dependence of the remaining ellipticity. However, this type coupling means, as shown by the curve 19 of FIG. 3, simultaneously increases the amount of the remaining ellipticity. Therefore, the other type wavecoupling means are provided to produce the net result that the amount and additionally also the frequency dependence of the remaining ellipticity are reduced to a minimum, as shown by the curve 20 in FIG. 3.

Figure 6:
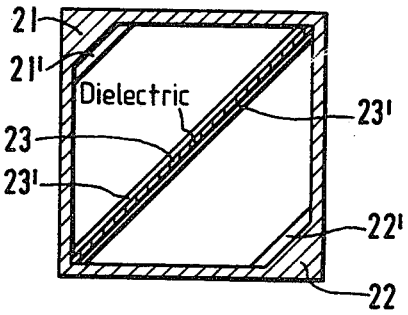
FIG. 6 is a cross-sectional view (not to scale) taken along the line A—A of FIG. 4 through the second polarization converter.

A preferred embodiment of a polarization converter 13 having the above-mentioned two different types of wavecoupling means is shown in FIG. 6, which is a cross-sectional view along the line A—A through the second polarization converter 13. As shown, the waveguide section of the polarization converter 13 has a square cross section of dimensions sufficient to permit propagation of signals in the higher frequency band. The reduction of the frequency dependence of the remaining ellipticity and also the increase in the amount are effected by two bevels 21 and 22 arranged in two diagonally opposite corners. A dielectric plate 23 which connects the other two diagonally opposite corners finally further reduces the amount and also the frequency dependence of the remaining ellipticity to a minimum i.e., the curve 20 of FIG. 3. The bevels 21, 22 as well as the dielectric plate 23 are here provided with gradations 21', 22' and 23' respectively, which function as $\lambda/4$ tranformation members in order to reduce the reflection coefficient. These gradations with one or more steps are provided at each side of the polarization converter in order to achieve an excellent broadband characteristic of the reflection coefficient.

Figure 8:
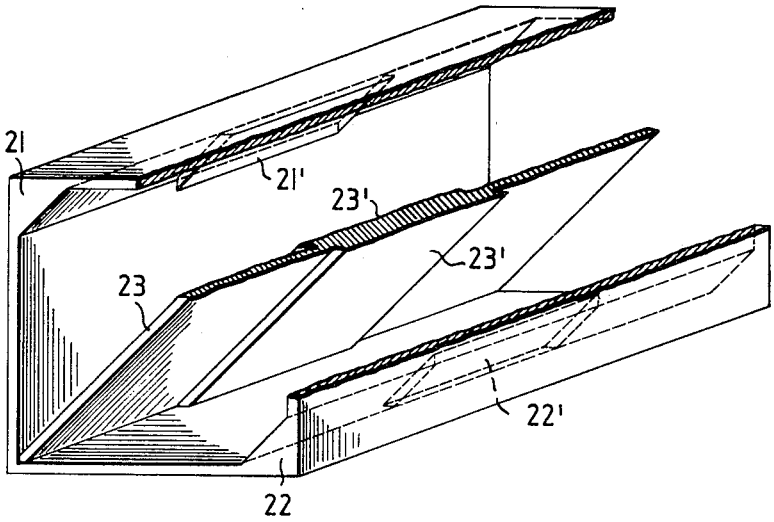
FIG. 8 is a (cut open) perspective representation of the second polarization converter whose cross-section is shown in FIG. 6.

From FIG. 8, which shows a (cut open) perspective representation of the second polarization converter 13, the actual shape of the converter and the two wave coupling means can be clearly seen. FIG. 8 illustrates the two bevels 21 and 22 which have in the beginning and the end a diagonal height of 3.2 mm and the dielectric plate 23 which has in the beginning and the end a thickness of 0.35 mm. These beginning- and end-sections of the bevels 21, 22 and the dielectric plate 23 have a length of $\lambda/4$, whereby the polarization converter has a length of 170 mm and the same inner width as the connected central waveguide body 10 of 30 mm. The middle gradated sections 21' and 22' of the bevels 21 and 22 have a diagonal height of 4.6 mm and the middle gradated section 23' of the dielectric plate 23 has a thickness of 0.74 mm.

The first polarization converter (FIG. 7) has the same structure as shown in FIG. 8, but is arranged orthogonally to the structure of the second polarization converter.

Figure 7:
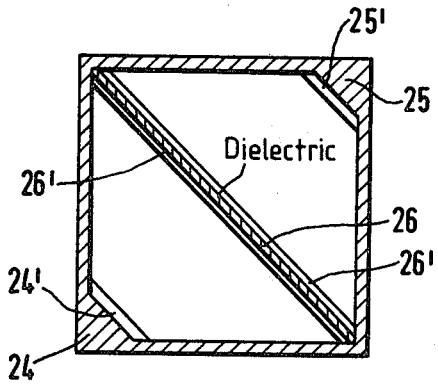
FIG. 7 is a cross-sectional view (not to scale) taken along the line B—B of FIG. 4 through the first polarization converter.

As shown in FIG. 7, the first polarization converter 11 for the lower frequency band is designed similarly to the second polarization converter 13 with bevels 24, 25 in two diagonally opposite corners and a dielectric plate 26 extending diagonally between the other two corners, the bevels 24 and 25 and the dielectric plate 26 are again provided with gradations 24', 25' and 26' respectively. The bevels 24, 25 and the dielectric plate 26, depending on the size selected for the side of the waveguide, may lie on the same cross-sectional diagonal or on different cross-sectional diagonals as shown.

As can be seen by a comparison of FIGS. 6 and 7, the bevels and the dielectric plate of the first polarization converter 11 are arranged to be offset by 90° with respect to the corresponding elements of the second polarization converter 13.

As an illustration of the effectiveness of the present invention, and with a four-port network as described above, the maximum ellipticity measured was 1.02 for the lower frequency band, which corresponds to a polarization decoupling of 40 dB, and the maximum remaining ellipticity measured was 1.012 for the upper frequency band, which corresponds to a polarization decoupling of 45 dB.

It is to be understood that the above description of the present invention is susceptible to various modifications, changes and adaptations, and the same are intended to be comprehended within the meaning and range of equivalents of the appended claims.

What is claimed is:

1. In a four-port network for separating signals comprised of two doubly polarized frequency bands for an antenna feeder system in directional or satellite radio operation, including a first polarization converter for converting linear polarization to circular polarization and vice versa and for providing the lowest inherent ellipticity in the lower frequency band, a symmetric polarization filter for the lower frequency band connected in series with said first polarization filter, and a second polarization converter, which compensates the remaining ellipticity in the upper frequency band, connected between said symmetrical polarization filter and a further polarization filter for the upper frequency band; the improvement wherein in order to provide the compensation for the remaining ellipticity in the upper frequency band, said second polarization converter includes: a first type of wavecoupling means for reducing the frequency dependence of the remaining ellipticity while simultaneously increasing the amount of the remaining ellipticity; and a second different type of wavecoupling means for producing the resultant effect that the amount of the remaining ellipticity and additionally its frequency dependence are reduced to a minimum.

2. A four-port network as defined in claim 1 wherein: said second polarization converter has a square cross section; said first type of wavecoupling means for reducing the frequency dependence of the remaining ellipticity comprises two bevels arranged in diagonally opposite corners of said square cross section; and said second different type of wavecoupling means comprises a dielectric plate disposed between two diagonally opposite corners of said square cross section.

3. A four-port network as defined in claim 2 wherein said dielectric plate is disposed between the other two diagonal corners of said square cross section.

4. A four-port network as defined in claim 2 or 3 wherein said bevels and said dielectric plate are provided with gradations which act as $\lambda/4$ transformations.

5. A four-port network as defined in claim 2 or 3 wherein: said first polarization converter has a square cross section and has bevels in two diagonally opposite corners of its said square cross section and a dielectric plate disposed between two diagonally opposite corners of its said square cross section; and said bevel and said dielectric plate of said first polarization converter are offset by 90° with respect to said bevels and said dielectric plate respectively of said second polarization converter.

* * * * *